US006237686B1

(12) United States Patent
Ryll et al.

(10) Patent No.: US 6,237,686 B1
(45) Date of Patent: May 29, 2001

(54) CEMENTING PLUG

(75) Inventors: Robert Lawrence Ryll, Sherwood Park; Colin George Reid, Airdrie, both of (CA)

(73) Assignee: Top-Co Industries Ltd., Edmonton (CA)

( * ) Notice: Subject to any disclaimer, the term of this patent is extended or adjusted under 35 U.S.C. 154(b) by 0 days.

(21) Appl. No.: 09/326,053

(22) Filed: Jun. 4, 1999

(51) Int. Cl.[7] ..... E21B 23/10; E21B 33/16
(52) U.S. Cl. ..... 166/153; 166/291
(58) Field of Search ..... 166/192, 153, 166/285, 291, 281, 150.14, 152, 386, 177.3, 154, 155, 156, 170, 171, 193

(56) References Cited

U.S. PATENT DOCUMENTS

| | | | | |
|---|---|---|---|---|
| 3,550,683 | | 12/1970 | Comeaux | 166/156 |
| 3,572,433 | * | 3/1971 | Conrad | 166/155 X |
| 4,042,014 | * | 8/1977 | Scott | 166/154 X |
| 4,190,111 | | 2/1980 | Davis | 166/291 |
| 4,190,112 | | 2/1980 | Davis | 166/291 |
| 4,711,300 | | 12/1987 | Wardlaw, III | 166/153 |
| 4,836,279 | | 6/1989 | Freeman | 166/153 |
| 4,858,687 | | 8/1989 | Watson et al. | 166/153 |
| 5,095,980 | | 3/1992 | Watson | 166/192 |
| 5,165,474 | | 11/1992 | Buisine et al. | 166/242 |
| 5,234,052 | | 8/1993 | Coone et al. | 166/155 |
| 5,433,270 | | 7/1995 | La Fleur | 166/152 |

FOREIGN PATENT DOCUMENTS

| | | | |
|---|---|---|---|
| WO93/08366 | 10/1992 | (EP) | E21B/33/16 |
| WO94/11610 | 11/1993 | (EP) | E21B/33/16 |

* cited by examiner

*Primary Examiner*—David Bagnell
*Assistant Examiner*—Kamal Dawelbeit
(74) *Attorney, Agent, or Firm*—Christensen O'Connor Johnson Kindness PLLC

(57) ABSTRACT

A cementing plug has a plurality of body segments which are secured together, preferably by adhesive, to form a plug body. Elastomer wipers are clamped between the body segments. This cementing plug may be readily made shorter or longer in length with an increased or decreased number of wipers. Elastomer covers only the wipers and not the plug body.

4 Claims, 5 Drawing Sheets

CEMENTING PLUG

FIELD OF THE INVENTION

The present invention relates to a cementing plug and, more particularly to an easily drillable plug for use in well cementing operations.

BACKGROUND OF THE INVENTION

It is conventional practice, in the drilling and completion of wells, that prior to the placement of cement, the casing and hole are filled with drilling mud. In order to reduce contamination of the interface between the mud and the cement a bottom cementing plug is placed in the casing and pumped ahead of the cement slurry. The bottom plug is typically constructed with a one piece hollow metallic or a one piece non-metallic core having an elastomer covering molded to the core. The elastomer cover typically incorporates a plurality of wipers. The function of the wipers is to wipe the internal surface of the casing, maintain the separation of fluids during the displacement of the cement slurry down the casing and provide a means of sealing upon displacement of the plug. The bottom plug incorporates a rupture diaphragm that will rupture upon the bottom plug reaching a float shoe, float collar or landing collar located near or at the bottom of the casing. When the bottom plug reaches the float shoe, float collar or landing collar, the increase in fluid pressure will result in the diaphragm rupturing allowing the cement slurry to pass though the bottom plug and continue out the bottom of the casing, filling the space between the casing and the well bore.

Upon placing all the cement into the casing a top plug is located on top of the cement. The top plug is typically constructed having a solid elastomer, one piece metallic or one piece non-metallic core having an elastomer covering molded to the core, the elastomer cover incorporating a plurality of wipers. The function of the wipers is to wipe the internal surface of the casing, maintain the separation of fluid during the displacement of cement slurry down the casing and provide a method of providing a sealing mechanism upon landing the top plug on top of the bottom plug. When displacement of the cement slurry is complete the top plug will land on top of the bottom plug remaining in this position. The required length for the top plug and the bottom plug varies with the intended application, and is based upon a number of factors including the pressure being contained.

After the cement slurry has become hard, the top and bottom plugs are drilled out using a drilling bit. Typical prior art cementing plug sets incorporate teeth, lugs or threads that act to prevent the plugs from rotating during the drill-out procedure, thereby reducing the time required to perform the drill-out operation.

SUMMARY OF THE INVENTION

What is required is an alternative configuration of cementing plug.

According to the present invention there is provided a cementing plug which includes a plurality of body segments. Means is provided for securing the plurality of body segments together to form a plug body. Elastomer wipers clamped between the body segments.

The use of a plurality of body segments enables plugs to be produced of varying lengths without having to produce additional molds for molding the plastic cores and elastomer covers. Prior art cement plugs used a one-piece molded core ith a one piece molded elastomer covering. To manufacture the prior art cementing plugs, molds for the plastic cores and molds for the elastomer covers were produced with each mold producing a plug of a set length. With the prior art should it be desired to produce a plug of shorter or longer length of a plug with an increased or decreased number of wipers a new set of molds would be produced to manufacture the new plug. The present invention allows the plug length and the number of wipers incorporated in the plug to be varied by the adding additional segmented plastic cores and wipers. It is intended that each of the body segments be substantially identical, but this is not essential. There are a variety of ways of securing the body segments together, several of which will hereinafter be further described.

Although beneficial results may be obtained through the use of the cementing plug, as described above, even more beneficial results may be obtained when the body segments are made from polymer plastic. Metal and rubber are difficult to drill. With the cementing plug, as described above, the metal and rubber can largely be replaced with more drillable materials, such as plastics.

Although beneficial results may be obtained through the use of the cementing plug, as described above, even more beneficial results may be obtained when a variety of elastomer wipers are used made from elastomers with differing properties. The prior art cementing plugs covered a core with an elastomer cover. This necessarily required that the elastomer wipers be made of the same elastomer materials as the elastomer cover. The selection of elastomer materials, therefore, was of importance. Some elastomers work more effectively for wiping, other elastomers work better at elevated temperatures, other elastomers have better wear properties and other elastomers have better compatibility with specific wellbore fluids. With the cementing plug, as described above, the elastomer wipers need not all have the same properties. A number of elastomer wipers with differing properties can, therefore, be configured to improve performance of the plug in a wide range of downhole operating conditions and fluids. In addition, the cementing plug described above has reduced the amount of elastomer material used, by using individual wipers that are locked between the molded plastic segments which replaces much of the elastomer material with plastic. The elastomer cover that normally covers the core between the wipers is eliminated, which improves the ability to drill out the plugs.

Although beneficial results may be obtained through the use of the cementing plug, as described above, it is important that the elastomer wipers be securely attached to the plug body. Even more beneficial results have, therefore, be obtained when the body segments have opposed mating faces with a receptacle on each of the faces, and each of the elastomer wipers has radial projections. The radial projections are received in the receptacles of mating body segments to lock the elastomer wipers to the plug body.

Although beneficial results may be obtained through the use of the cementing plug, as described above, it slow the drilling process if the body segments rotate when a force is exerted upon them by a drill bit during drilling out of the cementing plug. Even more beneficial results may, therefore, be obtained when the body segments have a projecting lug on one face and a lug receiving aperture on an opposed face. When the body segments are secured together, the projecting lug of one of the body segments engages the lug receiving aperture of another of the body segments to prevent relative rotation of the body segments.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred embodiment, a cementing plug will now be described with reference to FIGS. 1 through 5.

Figure 1:
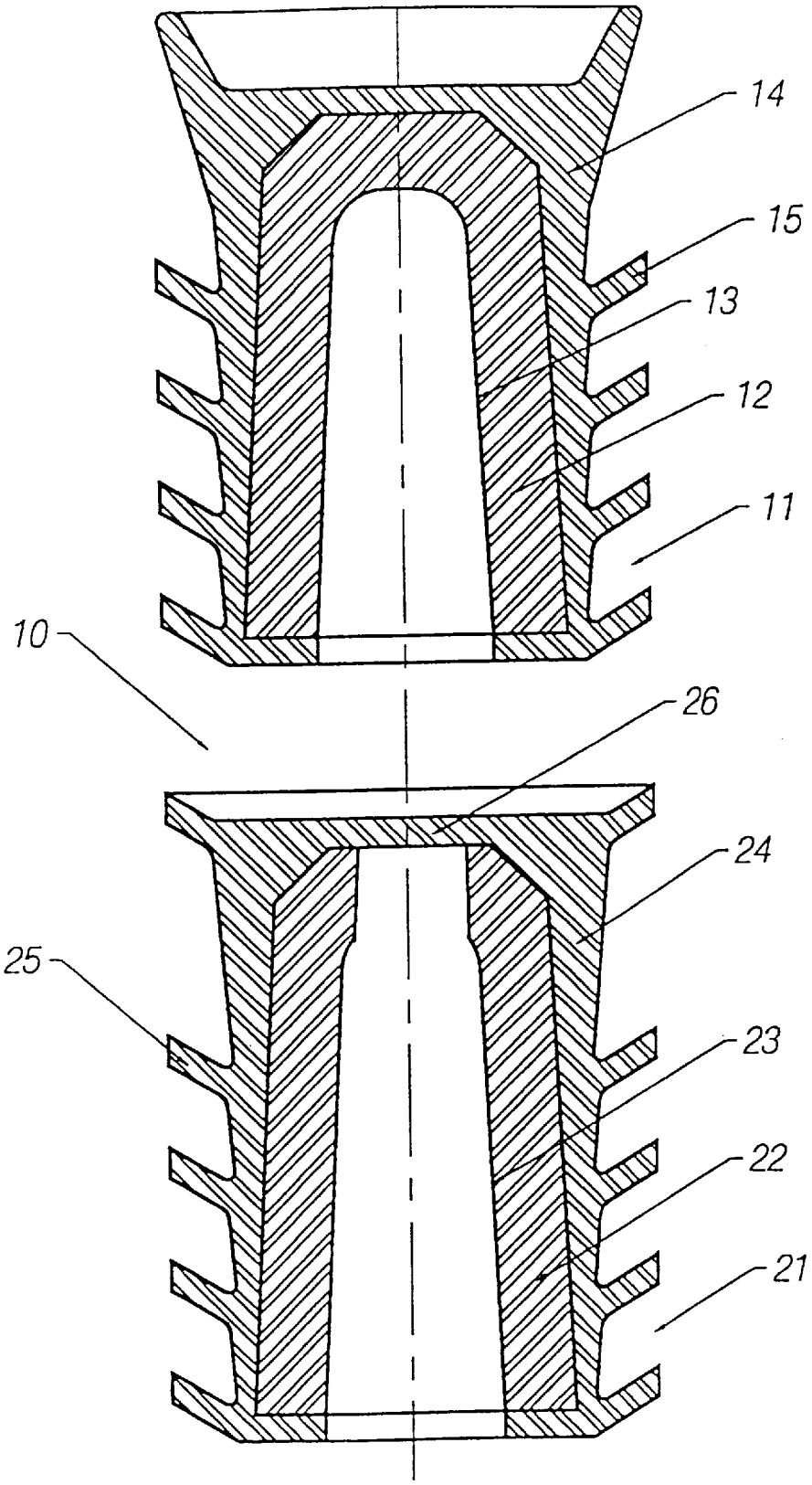
FIG. 1 PRIOR ART
FIG. 1, labelled as PRIOR ART, is a cross-sectional view of a prior art non-metallic plug set.

Referring to FIG. 1, a prior art non-metallic plug set 10 is shown. The top plug 11 comprises a plastic body 12 having a central cavity 13 and a one piece elastomer cover 14 thereon having a plurality of wipers 15. The bottom plug 21 comprises a plastic body 22 having a bore 23 throughout and an elastomer cover 24 thereon having a plurality of wipers 25 and a diaphragm 26.

Figure 2:
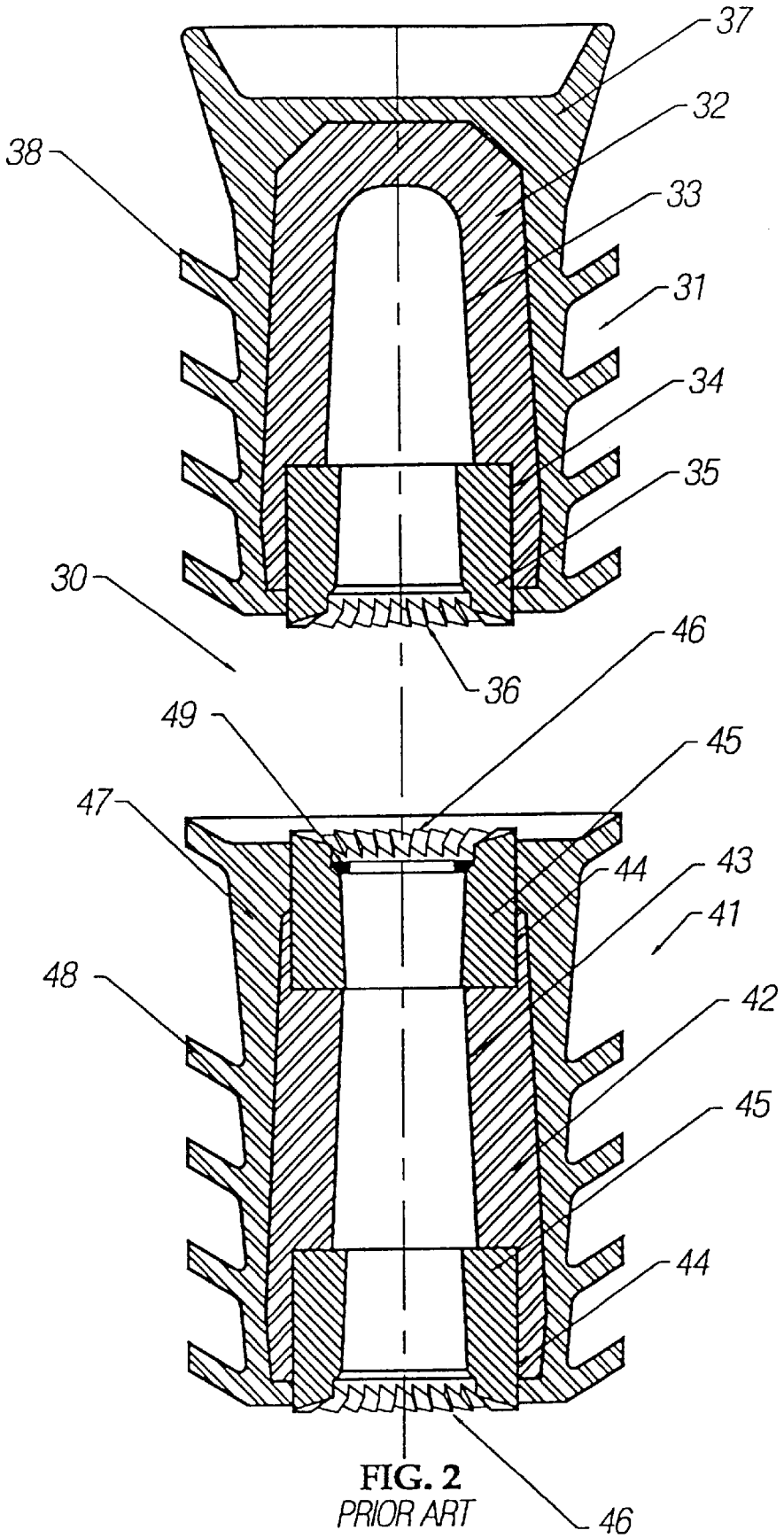
FIG. 2 PRIOR ART
FIG. 2, labelled as PRIOR ART, is a cross-sectional view of a prior art non-metallic, non-rotating plug set.

Referring to FIG. 2, a prior art non-metallic, non-rotating plug set 30 is shown. The top plug 31 comprises a plastic body 32 having a central cavity 33 therein and a bore 34 in the lower end, in which a non-rotating insert 35 having lugs 36 thereon is retained by adhesive bonding of the insert 35 to the body member 32. Top plug 31 has an elastomer cover 37 with a plurality of wipers 38 thereon. The bottom plug 41 comprises a plastic body 42 having a bore 43 throughout and a bore 44 in the lower and upper ends, in which a non-rotating inserts 45 having lugs 46 thereon is retained by adhesive bonding of the inserts 45 to the body member 42. Bottom plug 1 has an elastomer cover 47 having a plurality of wipers 48 hereon and a diaphragm 49.

Figure 3:
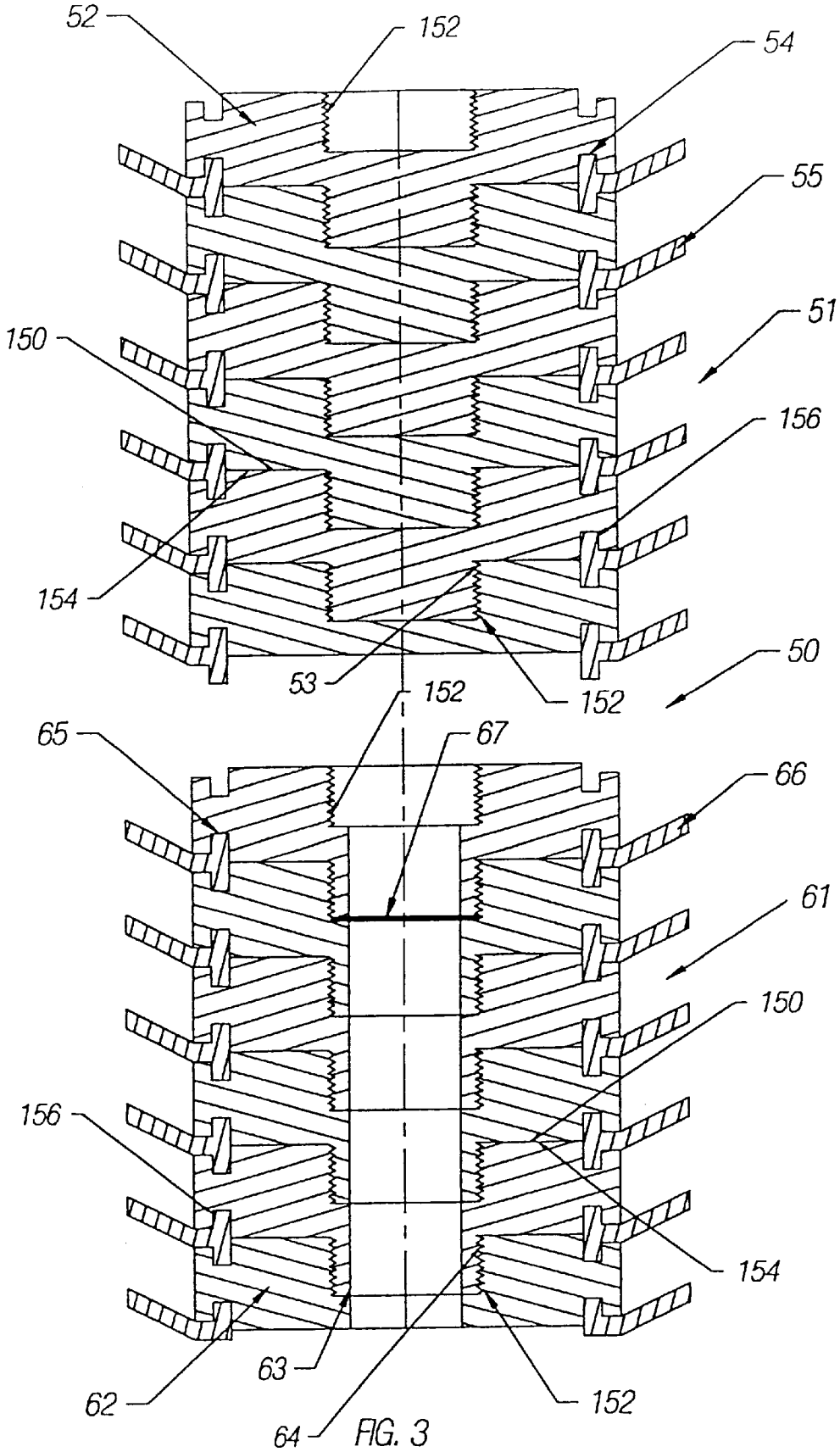
FIG. 3 is a cross-sectional view of one embodiment of the non-metallic segmented plug set encompassing threaded segments for the purpose of assembly.

Referring to FIG. 3, plug set 50 is illustrated which represents a first embodiment constructed in accordance with the teachings of the present invention is shown. The plug set comprises a top plug 51 and a lower plug 61. The top plug 51 is comprised of molded plastic body segments 52. Each segment has a threaded male projection 53 on one face 150 and a threaded female aperture 152 on an opposed face 154. Body segments 52 are secured together by mating threaded male projection 53 of one of body segments 52 with threaded female aperture 152 of another of the body segments 52. Each molded segment 52 has a receptacle 54 in each of faces 150 and 154 for retaining a plurality of wipers 55. Each of wipers 55 have radial projections 156 which are received in receptacles 54. The engagement between radial projections 156 and receptacles 54 prevents wipers 55 from being withdrawn when clamped between adjacent ones of molded segment 52. The bottom plug 61 comprises molded plastic segments 62. Each segment 62 has a threaded male projection 64 on one face 150 and a threaded female aperture 152 on an opposed face 154. Body segments 62 are secured together by mating threaded male projection 64 of one of body segments 62 with threaded female aperture 152 of another of the body segments 62. Each molded segment 62 has a receptacle 65 in each of faces 150 and 154 for retaining a plurality of wipers 66. Each of wipers 66 have radial projections 156 which are received in receptacles 65. Bottom plug 61 differs from top plug 51 in that bottom plug 61 has a central cavity 63 with a diaphragm 67 located in central cavity 63.

Figure 4:
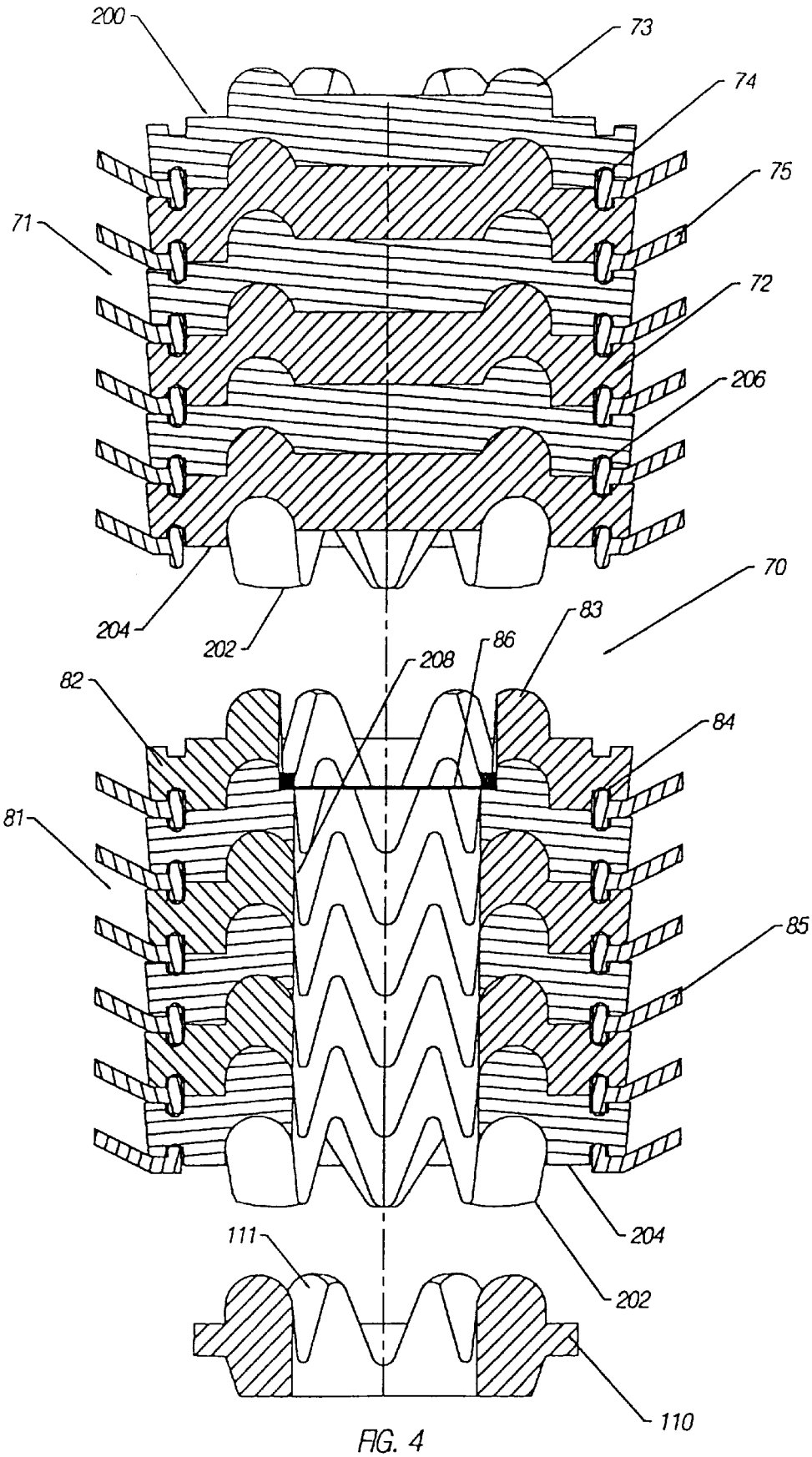
FIG. 4 is a cross-sectional view of another embodiment of the non-metallic segmented plug set encompassing adhesive bonding for the purposes of assembly.

Referring to FIG. 4, a plug set 70 is illustrated which respresents a second embodiment of a form of cementing plug constructed in accordance with the teachings of the present invention. Plug set 70 includes a top plug 71, a bottom plug 81 and plug seat 110. The top plug 71 is comprised of molded plastic segments 72, each segment having interlocking lugs 73 on one face 200 and a lug receiving aperture 202 on an opposed face 204. When segments 72 are secured together projecting lug 73 of one of the segments 72 engages lug receiving aperture 202 of another of the segments 72. This prevents relative rotation of the segments 72. Each of segments 72 has a receptacle 74 for retaining a wiper 75. Each of wipers 75 have radial projections 206 which are received in receptacles 74. The bottom plug 81 includes molded plastic body segments 82. Each segment has interlocking lugs 83 on one face 200 and a lug receiving aperture 202 on an opposed face 204. When segments 82 are secured together projecting lug 83 of one of the segments 82 engages lug receiving aperture 202 of another of the segments 82. This prevents relative rotation of the segments 82. Each segment 82 has a receptacle 84 for retaining a plurality of wipers 85. Each of wipers 85 have radial projections 206 which are received in receptacles 84. Bottom plug 81 differs from top plug 71 in that a central cavity 208 is provided in which is positioned a diaphragm 86.

The plug seat 110 has integral interlocking lugs 111 for use with plug set 70 during cementing operations. The lug receiving apertures 202 on plug 71 interlock with the lugs 83 on the top of plug 81. Lug receiving aperture 202 on the bottom of plug 81 interlock with the lugs 111 on the plug seat 110 so that rotation of both top plug 71 and bottom plug 81 is prevented. The plug seat 110 may be installed in any suitable cementing equipment such as a float collar, float shoe, guide shoe or landing collar.

Figure 5:
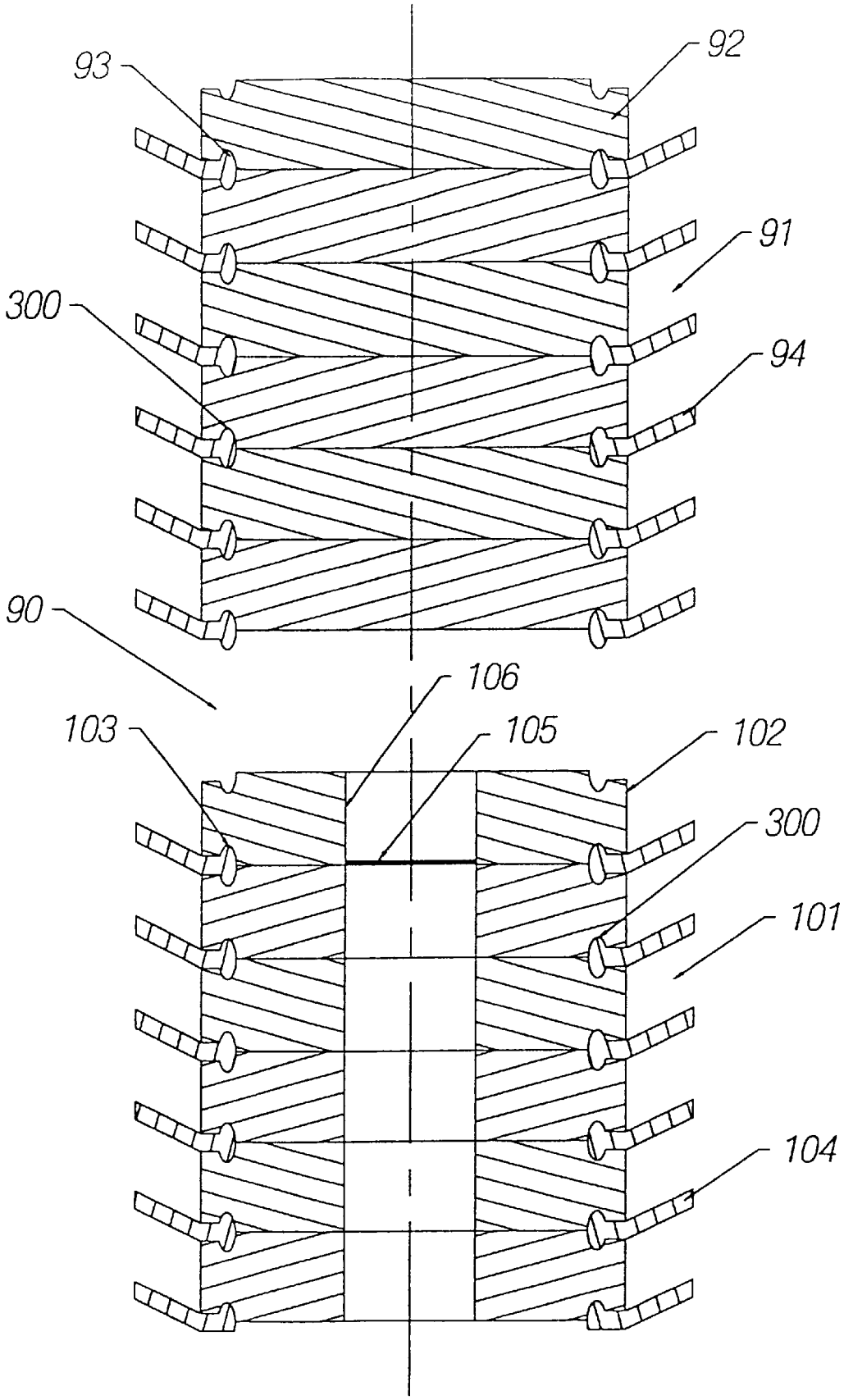
FIG. 5 is a cross-sectional view of another embodiment of the non-metallic segmented plug set encompassing adhesive bonding for the purpose of assembly and non-rotating lugs.

Referring to FIG. 5, a plug set 90 is illustrated which represents a third embodiment of the present invention. The plug set comprises of a top plug 91 and a bottom plug 101. The top plug 91 is comprised of plastic segments 92 bonded together by adhesive with each segment 92 having a receptacle 93 to retain a plurality of wipers 94. Each of wipers 94 has radial projections 300 which are received in receptacles 93. The bottom plug 101 is comprised of molded plastic segments 102 bonded together by adhesive. Each segment has a receptacle 103 to retain a plurality of wipers 104. Each of wipers 104 has radial projections 300 which are received in receptacles 93. Bottom plug 101 differs from top plug 91 in that bottom plug 101 has a central bore 106 in which is positioned a diaphragm 105.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A cementing plug, comprising:

a plug body consisting solely of a plurality of substantially identical individual plastic body segments secured together in face to face relation with adhesive, the body segments having a projecting lug on one face and a lug receiving aperture on an opposed face, such that when the body segments are secured together the projecting lug of one of the body segments engages the lug receiving aperture of another of the body segments, thereby preventing relative rotation of the body segments, the body segments having a receptacle on each of the faces;

a plurality of elastomer wipers clamped between the body segments, the elastomer wipers having radial projections that are received in the receptacles of the body segments to secure the elastomer wipers to the plug body, the plug body being expandable by adding additional ones of the body segments with additional ones of the elastomer wipers clamped therebetween.

2. The cementing plug as defined in claim 1, wherein the elastomer wipers are made from elastomers with differing properties.

3. A cementing plug, comprising:

a plug body consisting solely of a plurality of substantially identical individual plastic body segments, the body segments having a threaded male projection on one face and a threaded female aperture on an opposed face, the plurality of body segments being secured together by mating the threaded male projection of one of the body segments with the threaded female aperture of another of the body segments, the body segments having a receptacle on each of the faces; and a plurality of elastomer wipers clamped between the body segments, the elastomer wipers having radial projections that are received in the receptacles of the body segments to secure the elastomer wipers to the plug body, the plug body being expandable by adding additional ones of the body segments with additional ones of the elastomer wipers clamped therebetween.

4. The cementing plug as defined in claim 3 wherein the elastomer wipers are made from elastomers with differing properties.

* * * * *

UNITED STATES PATENT AND TRADEMARK OFFICE

CERTIFICATE OF CORRECTION

PATENT NO. : 6,237,686 B1
DATED : May 29, 2001
INVENTOR(S) : R.L. Ryll et al.

It is certified that error appears in the above-identified patent and that said Letters Patent is hereby corrected as shown below:

Title page,
Item [30] Foreign Application Priority Data, insert the following in appropriate order:
--[30] Foreign Application Priority Data Jun. 5, 1998 (CA) 2,239,748

Column 6,
Line 12, "claim 3" should read -- claim 3, --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*